US006655098B2

(12) United States Patent
Dillen, II et al.

(10) Patent No.: US 6,655,098 B2
(45) Date of Patent: Dec. 2, 2003

(54) STAIR MODULE SUPPORT AND LEVELING SYSTEM

(75) Inventors: William A. Dillen, II, Mechanicsburg, PA (US); Donald E. Dahowski, York, PA (US); Allen L. Kinner, Lititz, PA (US); Matthew A. Cramer, Lancaster, PA (US); James G. Wilson, Lancaster, PA (US)

(73) Assignee: Quaker Plastic Corporation, Mountville, PA (US)

( * ) Notice: Subject to any disclaimer, the term of this patent is extended or adjusted under 35 U.S.C. 154(b) by 0 days.

(21) Appl. No.: 09/974,803

(22) Filed: Oct. 12, 2001

(65) Prior Publication Data

US 2003/0070369 A1 Apr. 17, 2003

(51) Int. Cl.[7] ..... E04H 3/16

(52) U.S. Cl. ..... 52/182; 52/183; 52/184; 248/188.9

(58) Field of Search ..... 52/169.7, 182, 52/183, 184, 69; 248/677, 188.8, 188.9, 439, 188.6

(56) References Cited

U.S. PATENT DOCUMENTS

| | | | | | |
|---|---|---|---|---|---|
| 1,652,100 | A | * | 12/1927 | Eastburn | 297/141 |
| 1,923,163 | A | * | 8/1933 | Noelting | 248/188.8 |
| 2,903,222 | A | * | 9/1959 | Levi | 248/169 |
| 3,204,910 | A | * | 9/1965 | Gacher | 269/74 |
| 3,796,169 | A | * | 3/1974 | Bales et al. | 108/116 |
| 3,798,856 | A | | 3/1974 | Gloskowski | |
| 4,011,695 | A | * | 3/1977 | Simmons, Sr. | 52/8 |
| 4,068,427 | A | | 1/1978 | Camardo | |
| 4,083,156 | A | | 4/1978 | Tye | |
| 4,261,460 | A | | 4/1981 | Peterson, II | |
| 4,505,408 | A | * | 3/1985 | Sagol | 222/185.1 |
| 4,589,237 | A | * | 5/1986 | Dahowski | 52/169.7 |
| 4,854,092 | A | * | 8/1989 | Chatenay epouse | 52/10 |
| 4,873,802 | A | * | 10/1989 | Dahowski | 52/184 |
| 4,880,203 | A | | 11/1989 | Holcomb et al. | |
| 5,010,699 | A | | 4/1991 | Maiuccoro et al. | |
| 5,085,398 | A | | 2/1992 | Holcomb et al. | |
| 5,086,595 | A | | 2/1992 | Maiuccoro et al. | |
| 5,271,596 | A | | 12/1993 | Holcomb et al. | |
| 5,752,350 | A | * | 5/1998 | Maiuccoro | 52/169.7 |
| 6,029,407 | A | * | 2/2000 | Schillero, Jr. | 52/127.2 |
| 6,065,254 | A | | 5/2000 | Lanka | |

* cited by examiner

*Primary Examiner*—Carl D. Friedman
*Assistant Examiner*—Basil Katcheves
(74) *Attorney, Agent, or Firm*—Nixon Peabody LLP; Daniel S. Song

(57) ABSTRACT

An improvement to a stair module support system includes a flexible engagement between a post and a channel attached to the underside of a stair module. The flexible engagement enables the stair module support system to be assembled and placed into a stored configuration with each post received by a corresponding channel. The system may then be shipped to an installation site where the posts may be rotated to a deployed position without requiring further assembly or tools.

21 Claims, 14 Drawing Sheets

100
102
104
106
108
110
112
114
116

200
202
204
206
208
212
224
226
228

302
308
304

302
310
304

300
316
302
308
322
304
306
320

STAIR MODULE SUPPORT AND LEVELING SYSTEM

BACKGROUND OF THE INVENTION

1. Field of the Invention

The present invention relates generally to stair module support systems. More particularly, the present invention relates to a stair module support system including a flexible engagement between the stair module and the support posts that permits quick and simple deployment of the support posts without requiring tools.

2. Description of Related Art

Conventional installation procedures of prefabricated modular stair units have been time-consuming and tedious and, therefore, expensive. Additionally, the stability against shifting or settling of the installed stair module have been unsatisfactory.

One common method used to install a modular stair involves the construction of columns or piers under the stair module. The columns generally include two or more concrete blocks and/or bricks which rest on a concrete footer. The columns abut the underside of one or more steps on the stair module. It is important and difficult to construct a footer that is level and which resists settling and/or misalignment. Conventional support columns are required to be built on the footer from the ground up to provide support for the stair module. Additionally, shims are required to attain proper leveling of the stair module. This leveling is particularly important when the stairs form a portion of a contiguous wall in a swimming pool.

Another conventional method for supporting modular stairs uses a truss system. For example, U channel fixtures may be secured to a collar and to the front base of a riser of the modular stairs. The fixtures are then used to attach a truss support to the stair module. This system requires an elaborate and difficult to assemble truss system which requires multiple threaded fasteners.

Each of the above-described conventional stair support systems require extensive assembly and installation procedures. Thereby, adding to the expense of installing a modular stair unit.

In 1986, Quaker Plastic Corporation patented a unique stair module support and leveling construction as disclosed in U.S. Pat. No. 4,589,237 the disclosure of which is incorporated herein in its entirety. The stair support system includes support posts attached to the underside of each stair tread using a channel. The post is secured to the channel using rigid bolts or pins extending through downwardly extending side walls from the channel and through the support post. This arrangement facilitates installation of the stair module by allowing the support to be installed from the top, i.e. the underside of the stair module, down to the ground. Shoes are provided at the bottom of, and secured to the post in conjunction with a reinforcing rod. The stair module, with the underneath supporting post assembly secured to the stair module, is lowered in place and leveled. The bottom of the post, the shoes and the reinforcing rod are then buried in concrete to provide a footing.

Subsequently, in 1989, Quaker Plastic Corporation patented a system to impart controlled rigidity to the flexure of a molded plastic structural module as disclosed in U.S. Pat. No. 4,873,802, the disclosure of which is incorporated herein in its entirety.

SUMMARY OF THE INVENTION

The invention is an improvement on the unique stair module support system developed by the Quaker Plastic Corporation. An exemplary embodiment of the invention has a flexible engagement between the support posts and a channel or pad secured to the underside of the stair module. The engagement flexes to allow the support post to be rotated from a stored position to a deployed position. In an exemplary embodiment, the engagement may include a flexible connection which flexes to provide a tension to the post such that the post is biased against the underside of the stair module. Biasing the post against the stair module may establish the relative angle between the underside of the stair module and the post.

In an exemplary embodiment of the invention, the stair module support system is assembled at a manufacturing facility such that the support posts are stored in the channels for shipping and storage. Quaker Plastic Corporation has a trademark for the system which provides the ability to provide for easy shipping and storage. The trademark is LOCK DOWN BLEACHER SYSTEM™. The flexible engagement is substantially stress free in the post storage configuration. At the installation site, the post is rotated from the stored position in the channel into the deployed position. The flexible engagement enables the post to rotate from the stored position to the deployed position and may maintain a tension on the post to maintain the post in its deployed position.

Each post may include a shoe attached to the bottom end of the post. The shoe includes hooks that may interact with corresponding barbs on the walls of the channel to latch the shoe and attached post into the stored configuration. The hooks of the shoe easily unlatch from the channel for deployment of the post. The shoe may also include a flexible engagement to the post in a manner similar to the flexible engagement between the post and the channel attached to the underside of the stair module. The engagement may also flex to bias the post into the shoe, in this way, the relative angular orientation of the shoe to the post may be established.

The invention is directed particularly to a support system for stair modules or "shells," primarily those that include a plurality of, i.e. two or more, steps. In an exemplary embodiment of the invention, the system supports the stair module from the top down to the support level, as distinguished from a system in which the support comprises building up from the ground to the underside of the stair module. In an exemplary embodiment, support plates or pads are used which are formed integrally on, bonded to or otherwise secured on the underside of the steps or stair module. The vertical support is secured to the support pad through extensions or protrusions which are formed on the support pad. By this arrangement of connecting the support post to the pad, through the extensions formed on the pad, any load, such as that of the water and/or persons placed on the stairs, is distributed evenly across the area of the pad and then to the support post which may be similarly connected to the pad and to the ground or substrate. This arrangement has the effect of allowing the equal distribution of load through the pad and into the post through direct contact with the top/end surface of the support post.

As described above, a shoe may be connected to the bottom of the support post using a flexible engagement, however, the support post may also have a reinforcing rod (rerod). The shoe, rerod and support post may be encapsulated in poured concrete as in a footer. The system affords a greater surface area on which to distribute any weight placed on the stairs. The stair shell or module support system, thus, includes an arrangement in which the stairs are supported by support posts in conjunction with support pads that are bonded to, or mechanically attached. etc. the underside of the steps.

In a first exemplary embodiment of the flexible engagement, the rigidizing channel has side walls which are provided with holes through which a flexible fastener passes through corresponding holes in upper end of the support posts. Wile the holes on the pads may be substantially aligned with the holes in the vertical posts when the posts are in the stored position, the two sets of holes may be slightly offset to provide a strain on the flexible fastener which acts in tension and/or shear to bias the post upward into firm contact with the underside of the pad and to solidly hold the post in a predetermined angular orientation with the pad.

In this first exemplary embodiment of the invention, the flexible fastener may be an elongate shaft having a head, a barrel, a barrel catch and an installation tail. The installation tail may be inserted through the holes in the side walls of the channel and the hole in the top end of the support post. The distal end of the installation tail, extending completely through this assembly, may then be pulled to bring the barrel catch through both holes in the side walls of the channel and the hole in the top of the support post. The tail may be pulled using a rotary tool that grasps the end of the installation tail and rotates to wrap the installation tool around the rotary tool. Once the barrel catch extends completely through, the installation tail may be removed. Thereby, leaving behind a flexible fastener having a head at a proximal end, a flexible barrel shaft extending through the channel and the support post and a barrel catch at a distal end.

The lower end of the post may similarly be connected to and rest upon a shoe placed on the ground or substrate. The shoes are so constructed as to suitably support the vertical posts and may have a construction similar to the support plates having vertical protrusions, side walls or extensions and holes therethrough which receive another flexible fastener to secure the post to the shoe. In the deployed position, holes in the shoes may be offset from the corresponding holes in the vertical post such that the flexible fastener may be strained. The strain causes the flexible fastener to act in tension and/or shear to bias the post into firm contact with the top of the shoe and to solidly hold the post in a predetermined angular orientation with the shoe. The holes in the shoes and the posts, however, may substantially align when the post is in the stored position in the shoe.

Alternatively, the shoe may be connected to the post using a flexible connection which allows the base of the shoe to be spaced a short distance from the lower end of the post so that the shoe has the ability to find its own relative angle between itself and the post. The angle between the shoe and the post may then be determined by the relative angle between the post and the ground surface upon which the shoe rests. This configuration enables the shoe to obtain a good footing with ground that may not be entirely level.

The lower ends of the posts may also have additional holes to receive a rerod horizontally disposed and in spaced relation and, preferably, at an angle substantially parallel to the flexible fastener in the shoe. The support shoes and rerod are suitably buried in concrete for greater strength. To enhance load support, additional posts may be added to engage the underside of additional steps of the stair module. Rerods may then be inserted through the vertical posts. In an alternative embodiment, the rerod may be positioned at an angle other than substantially parallel to the flexible fastener in the shoe, as for example, in a substantially perpendicular relative angle.

In a second exemplary embodiment of the invention, the flexible engagement between the post and the rigidizing channel may be provided by a flexible end of the post. For example, in this exemplary embodiment, the flexible engagement is established with a threaded fastener, such as a bolt, extending through both walls of the rigidizing channel and through a hole near the top of the post. Thus, while the threaded fastener is substantially rigid in the hole near the top of the post, the top end of the post is flexible such that as the post is rotated from a stored position to the deployed position, the top end of the post deforms to allow the rotation.

In a third exemplary embodiment of the invention, the flexible engagement may be provided using a flexible bushing. A flexible bushing is positioned in holes on both sides of the support post near the top end of the support post. Each of the flexible bushings may then have a hole that substantially aligns with the hole in the other. A threaded fastener extends through the holes in the walls of the rigidizing channel and through both holes in the flexible bushings. As the support post is rotated from the stored position to the deployed position, the flexible bushings flex to allow the support post to rotate. The flexible bushings may also slightly bias the post into the rigidizing channel to establish the relative angle between the post and the channel.

In a fourth exemplary embodiment of the invention, the flexible engagement between the support post and the rigidizing channel may be established using a flexible insert in the top end of the tubular post. The flexible insert may be a plug that inserts into the top end of post. The insert provides the flexibility between the top of the post and the channel. The insert is connected to the top end of the post using a fastener which extends through the side walls of the rigidizing channel, through holes in both sides of the post and through the flexible insert. The flexible insert may have a series of concentric rings and may be made from any flexible material. The flexible insert deforms in response to the channel to allow the post to rotate into the deployed position.

The invention provides several benefits over previous stair support systems. For example, the stair support system may be entirely manufactured, installed and assembled at the factory, thereby minimizing the risk of lost parts and incorrect assembly. The entire unit may be assembled and prepared for storage and shipping in a compact package. Once at the installation site, the posts merely need to be rotated into the deployed position much like the legs on a card table without the use of tools. No assembly is required at the installation site for the LOCK DOWN BLEACHER SYSTEM™. The deployment of the stair support system also does not require any special tools for installation. The stored posts also accommodate stacking of multiple units for shipping. Additionally, once the posts are deployed, they maintain their deployed position and do not flop around like conventional stair support systems.

These and other features and advantages of this invention are described in or are apparent from the following detailed description of exemplary embodiments.

BRIEF DESCRIPTION OF THE DRAWINGS

Exemplary embodiments of the invention will be described in detail, with reference to the following figures wherein.

DETAILED DESCRIPTION OF EXEMPLARY EMBODIMENTS

Figure 1:
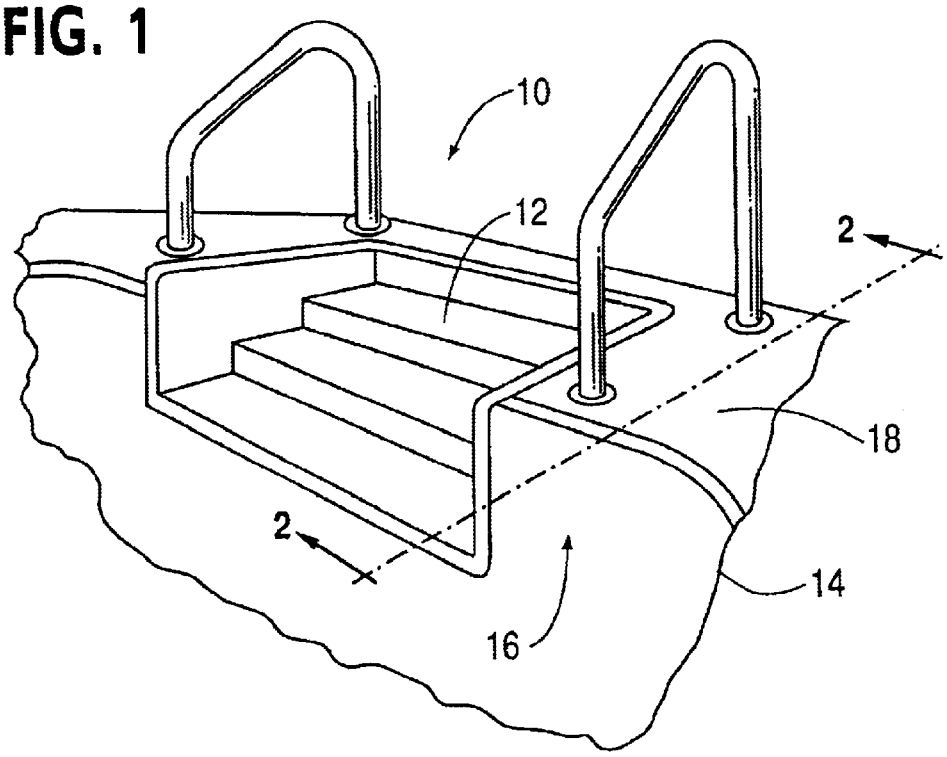
FIG. 1 is a perspective view of an exemplary stairwell installation shown in relationship to contiguous fragments of a swimming pool wall and deck in accordance with the invention.
Figure 2:
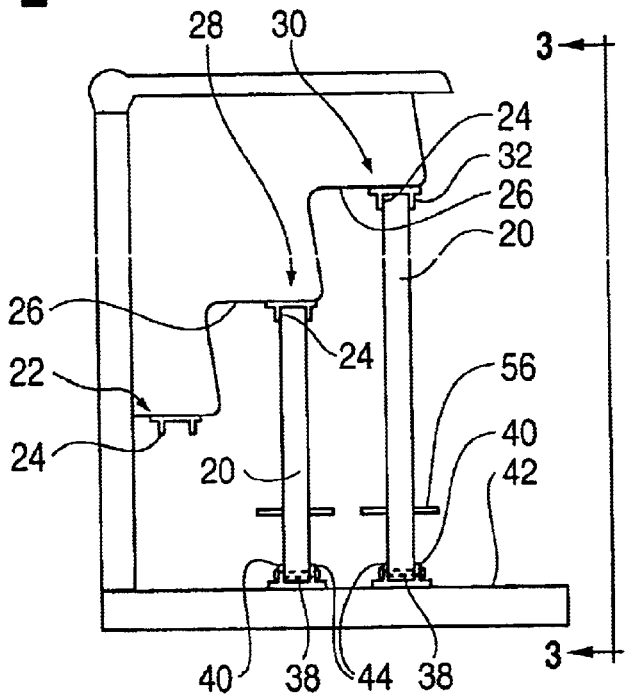
FIG. 2 is a view of the stair support system taken along line 2—2 of FIG. 1 illustrating two pairs of supporting vertical posts connected to the underneath of the steps of a stair module.
Figure 3:
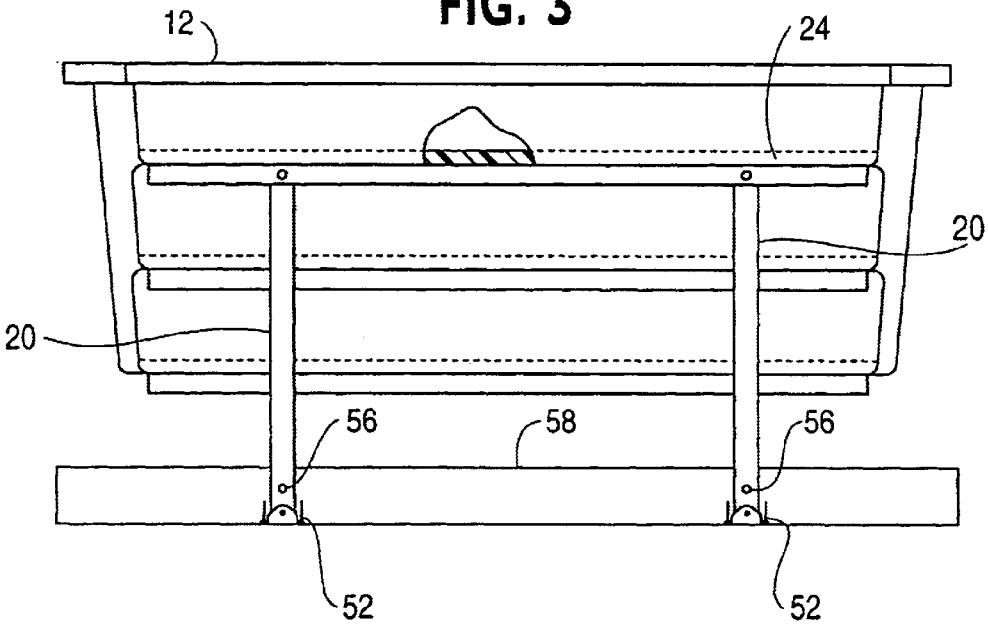
FIG. 3 is an elevation view taken along line 3—3 of FIG. 2.
Figure 9:
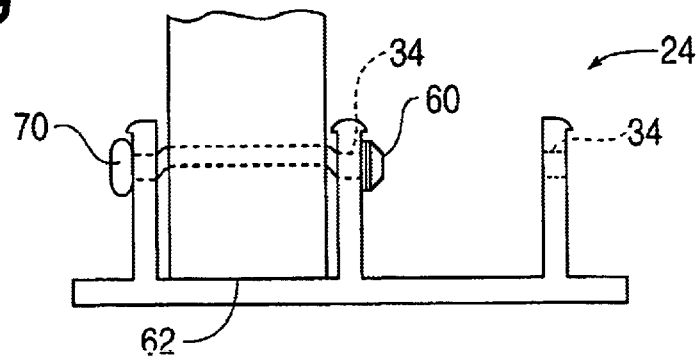
FIG. 9 is an elevation view of the exemplary embodiment of FIG. 7 showing the post in the deployed position.

FIG. 1 shows a perspective view of a first exemplary embodiment of a stair well installation 10 with a stair module 12 in position with a fragment of a pool 14. The stair module 12 is shown in place in an opening in the vertical pool wall 16 and horizontal deck 18 and is supported beneath by two pairs of support posts 20 as shown in FIGS. 2 and 3. In the stair module supporting arrangement of this exemplary embodiment channels 24 are bonded to, or otherwise fastened to the underside 26 of steps 22, 28 and 30. The channels 24 each have suitable protrusions 32 (FIG. 7) which may take the form of depending sides, walls, extensions or legs which are provided with holes 34 which correspond with holes 36 in the upper ends of the support posts 20 which receive a flexible fastener 38 to secure the channels 24 to the posts 20. The holes 34 in the channels 24 and the holes 36 in the posts 20 are so arranged such that the holes 36 in the posts 20 are spaced further away from the underside 26 of the stairs than the corresponding holes 34 in the channels. Thus, as shown in FIG. 9, the non-alignment of the holes 34 and 36 strain the flexible fastener 38 from its straight configuration such that the flexible fastener 38 biases the posts 20 into firm contact with the underside of the channels 24.

Figure 10:
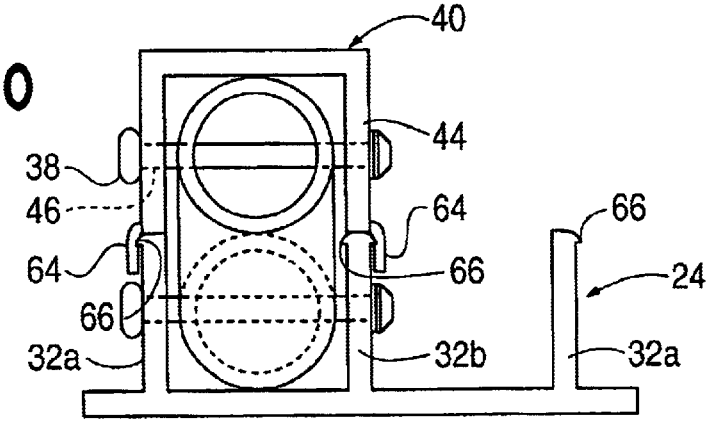
FIG. 10 is an elevation view from the opposite end shown in FIGS. 7–9 of the first exemplary embodiment of a channel engaging a shoe which is attached to a post through a flexible fastener in the stored configuration in accordance with the invention.

As shown in FIGS. 2 and 3, the lower ends of the posts 20 preferably rest upon shoes 40 on the ground 42. The shoes 40 may be constructed similarly to the channels 24 and may be formed of metal or a suitable plastic, having vertical extensions, walls or legs 44 and having holes 46 in the walls 44 (FIG. 11) which receive a flexible fastener 38 to secure the posts 20 to the shoes 40 (FIG. 10). The holes 46 are offset from the corresponding holes 48 (FIG. 13) in the bottom of the posts 20 such that the flexible fastener 38 is strained and biases the shoes 40 into firm contact with the bottom of the posts 20. The shoes 40 may also be provided with holes 50 (see FIG. 11) to receive anchoring stakes or pins 52 (FIG. 3).

The lower ends of the posts 20 may also have holes 54 (FIG. 13) to receive a rerod 56 horizontally disposed and in spaced relation and preferably parallel or alternatively perpendicular to the flexible fastener 38 (FIGS. 2 and 3). The shoes 40 and rerods 56 are then buried in concrete 58 for greater strength. Also, depending upon the size of the stair module 12 or for greater load support, additional posts (not shown) may be added and secured underneath other steps of the module 12. Additionally, for longer individual stair steps or treads, the module may include more than two posts flexibly engaging each individual step or tread.

Figure 4:
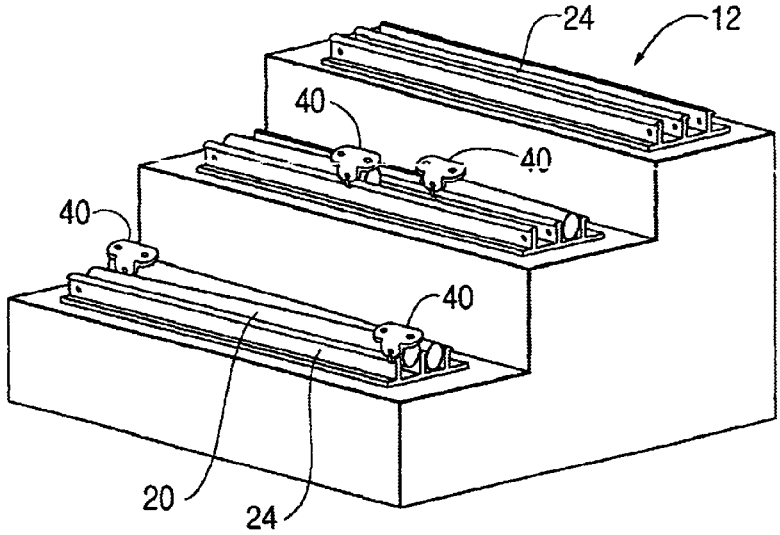
FIG. 4 is a perspective view of an exemplary embodiment of an upside down stair module with the supporting legs stored in accordance with the invention.
Figure 5:
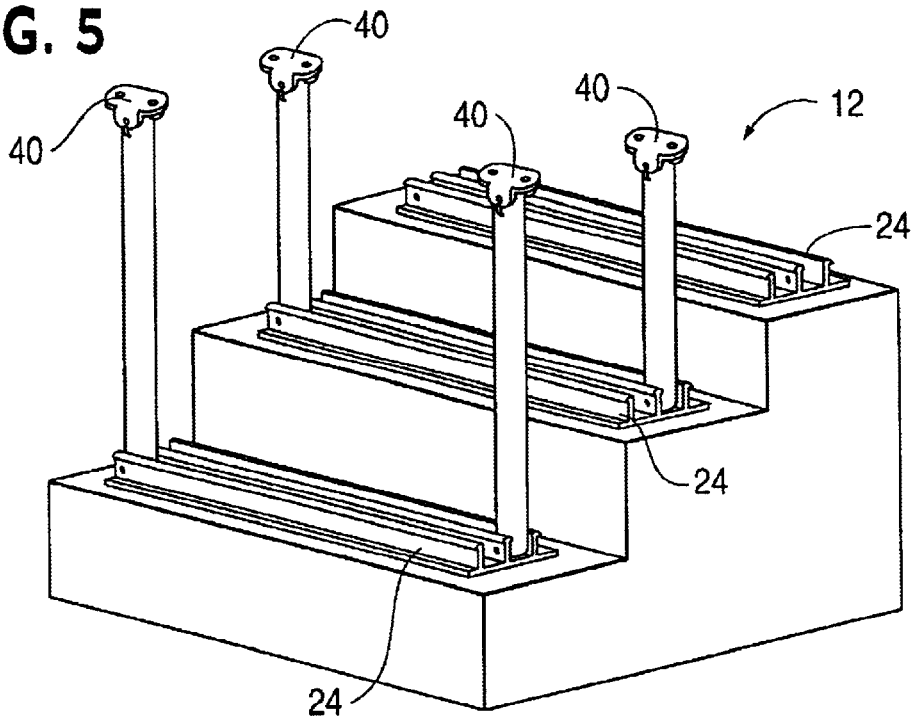
FIG. 5 is a perspective view of the exemplary embodiment of the upside down stair module of FIG. 4, but with the supporting legs in the deployed position in accordance with the invention.

FIG. 4 shows a perspective view of an exemplary embodiment of a stair module 12 with the posts 20 in the stored configuration. Each post 20 is stored in its corresponding channel 24 such that the shoe 40 connected to each post is latched to the channel 24 to hold the post 20 in the stored configuration. To deploy the posts 20 into the deployed position shown in FIG. 5, the shoe 40 for each post 20 is unlatched from its corresponding channel 24 and the post 20 is rotated into its deployed position. In the deployed position shown in FIG. 5, all of the posts 20 are substantially perpendicular to the attached channels 24. The shoes 40 for each post 20 have also been rotated to be substantially perpendicular to the posts 20.

Figure 6:
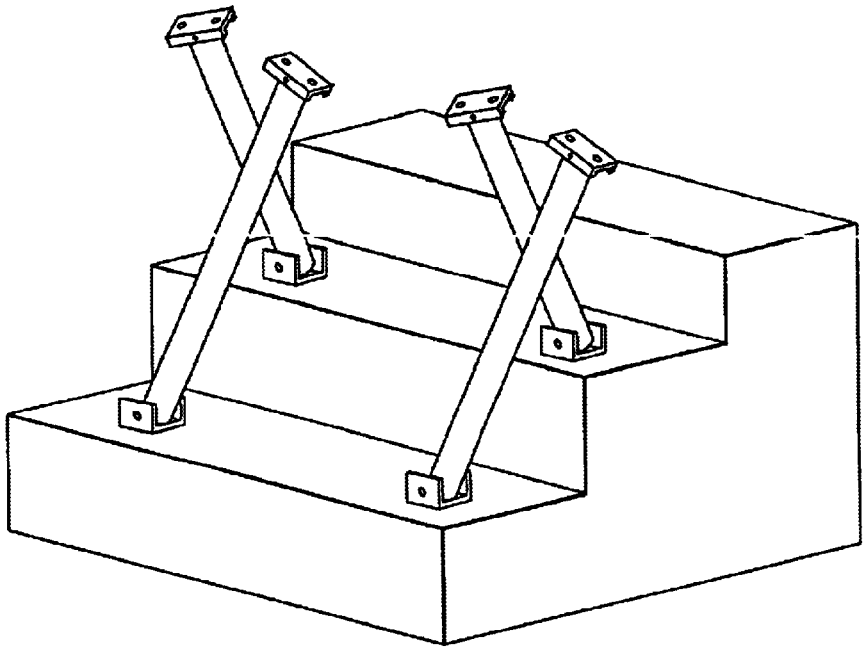
FIG. 6 (PRIOR ART)
FIG. 6 is a perspective view of an upside down stair module of the prior art with the supporting legs attached.

As is shown in comparison with the prior art embodiment of a stair support module shown in FIG. 6, the stair support module 12 of the present invention maintains the posts 20 at a predetermined angle relative to the channels 24. In this case, the posts 20 are substantially perpendicular to each channel 24. By contrast, the prior art embodiment of a stair support module permits the posts to "flop" back and forth and the relative angular position of the posts are not positively determined. Rather, the posts of the prior art stair support module are connected to the channel using conventional bolts which permit a clearance between the end face of the post and the channel.

Figure 7:
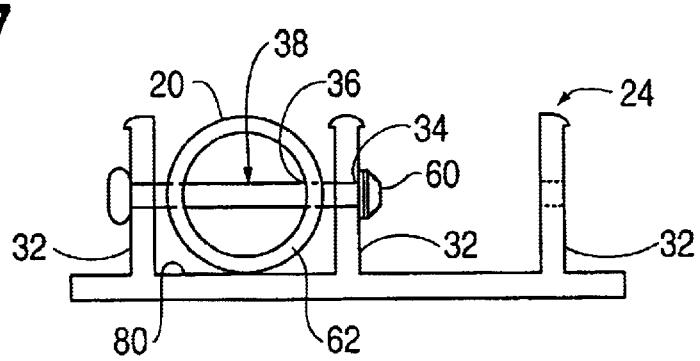
FIG. 7 is an elevation view of a first exemplary embodiment with a channel attached to a support post with a flexible fastener with the post in the stored configuration.
Figure 8:
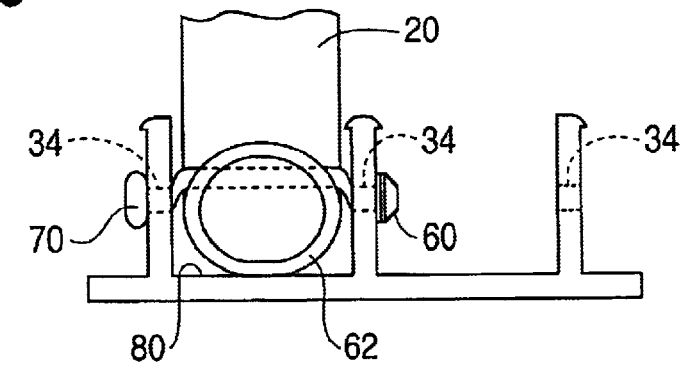
FIG. 8 is an elevation view of the exemplary embodiment of FIG. 7 but with the post in a transitional stage between the stored configuration and the deployed configuration.

The operation of the flexible fastener 38 may be seen more clearly with reference to FIGS. 7–9. FIGS. 7–9 show end views of the flexible engagement between the channel 24 and the post 20 using the flexible fastener 38 in accordance with the first exemplary embodiment of the invention. FIG. 7 shows the flexible fastener 38 passing straight through the holes 34 in the channel 24 and the holes 36 in the post 20. Preferably, the holes 34 and 36 are substantially aligned such that the flexible fastener 38 is substantially straight, although this is not absolutely necessary for proper operation.

Referring now to FIG. 8, the post 20 is seen in a rotated position which is intermediate the stored position shown in FIG. 7 and the deployed position shown in FIG. 9. It can be seen in FIG. 8 that as the post 20 is rotated, the holes 36 in the post 20 move upward out of alignment with the holes 34 in the channel 24. Thus, the flexible fastener 38 "flexes" to allow the post 20 to rotate. Thus, as is shown, the posts of the stair support system may be deployed much like the legs of a card table, very quickly and easily and without tools.

The flexible fastener 38 includes a barrel catch 60 on one end and a head 70 on the opposite end to prevent the fastener 38 from pulling through the holes 34 in the channel 24. It can also be seen in FIG. 8 that the top end surface 62 of the post 20 deforms slightly due to the force exerted between the flexible fastener 38 and the base 80 of the channel 24 which, at least, slightly resists the motion of the post.

FIG. 9 shows the post 20 in its deployed position. As can be seen, the flexible fastener 38 is at least slightly deformed because the holes 36 in the post 20 no longer align with the holes 34 in the channel 24. Because the flexible fastener 38 is made from an elastic material, the fastener 38 resists this deformation and tends to pull the post 20 into contact with the channel 24. While this first exemplary embodiment shows a deforming end 62 of the post 20, the deformation is not so large as to permanently distort the end surface of the post.

In this first exemplary embodiment, the post 20 has a substantially flat top surface 62 and the interaction of the flat top surface 62 abutting the base surface 80 of the channel 24 positively positions the post 20 relative to the channel 24. Although, the exemplary embodiment of the post 20 shown in these figures includes a flat top surface 62, it is to be understood that only two points on the top surface 62 need to contact the channel 24 to positively position the post 20 relative to the channel. The top surface 62 may also include beveled edges (not shown) to facilitate easier transitioning from the stored to the deployed position and/or may have a "V" notch (not shown) cut into the end surface 62. In general, the flexible engagement of the invention is valuable for a multitude of configurations not yet conceived but which may benefit from a flexible engagement between the post and the channel.

FIG. 10 shows an end view of shoe 40 latched onto the channel 24 in accordance with the first exemplary embodiment of the invention. The shoe 40 is positioned relative to the post 20 in the stored configuration such that the flexible fastener 38 is substantially relaxed. The shoe 40 includes two hooks 64 that are adapted to interact with corresponding flanges 66 extending substantially perpendicularly to the channel wall 32 from the end of the wall 32. The hooks 64 removably latch onto the flanges 66 to maintain the post 20 in the stored configuration. The outer walls 32*a* include outwardly extending flanges 66 and the inner wall 32*b* includes two flanges 66 extending in opposing directions. The flanges 66 extend substantially along the entire length of the channel 24 to enable a shoe 40 to latch substantially anywhere along the length of the channel 24 to accommodate varying lengths of post 20. The hooks 64 extend inwardly to interact with corresponding flanges 66 on the channel 24.

Figure 11:
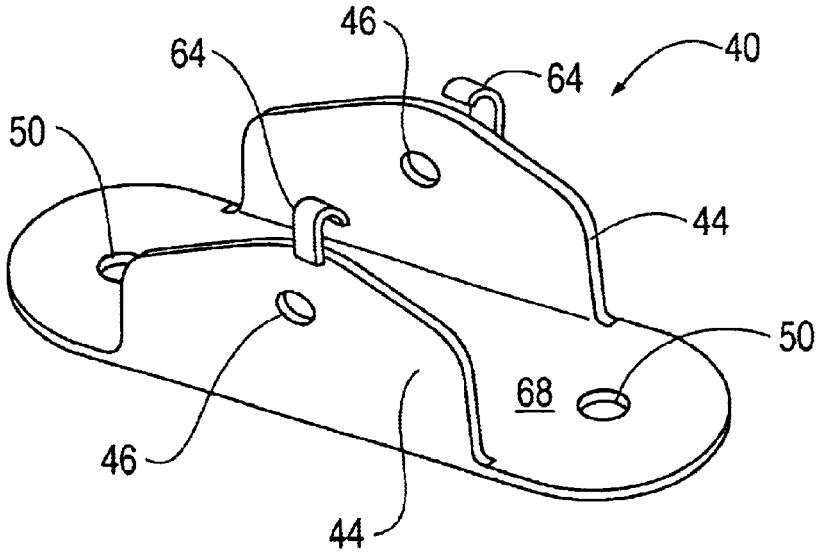
FIG. 11 is a perspective view of a shoe in accordance with an exemplary embodiment of the invention.

FIG. 11 shows a perspective view of an exemplary embodiment of a shoe 40 in accordance with the invention. Each shoe 40 includes a base 68 and a pair of walls 44 extending substantially perpendicularly from the base 68. As previously described the base 68 includes holes 50 that are adapted to receive anchoring stakes 52 (FIG. 3). Each wall 44 includes a hole 46 adapted to receive a flexible fastener 38 and a hook 64 projecting from the end of the wall 44.

Figure 12:
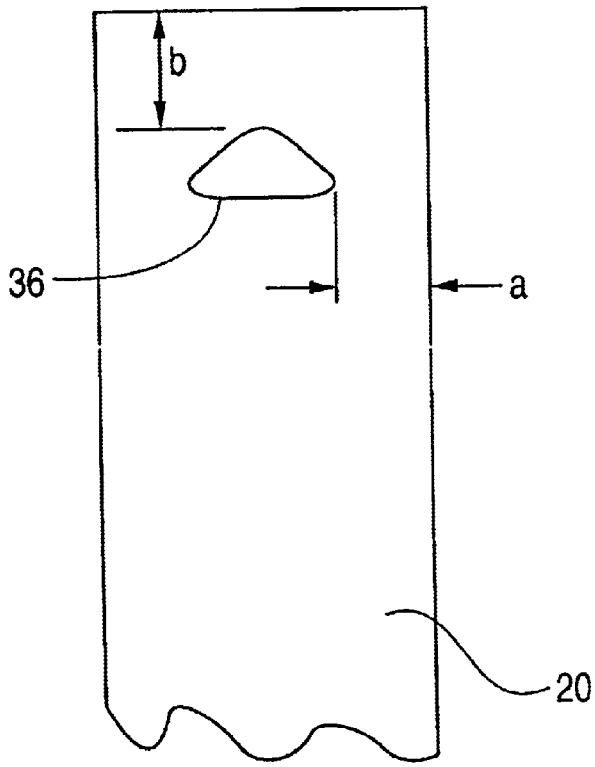
FIG. 12 is an elevation view of another post with a triangular hole in accordance with an exemplary embodiment of the invention.

FIG. 12 shows an elevation view of one end of an exemplary embodiment of a post in accordance with the invention. The post 20 includes a triangular hole 36. The hole 36 is triangular to control the amount of strain experienced by the flexible fastener 38 as the post 20 is moved from the stored position to the deployed position. In the stored position, the distance from the flexible fastener 38 to the channel 24 is the distance indicated as "a," while, in the deployed position, the distance from the flexible fastener 38 to the channel is the distance indicated as "b." Preferably, the distance "a" is substantially the same as the distance from the base 80 of the channel 24 to the hole 34 in the post 20 such that the flexible fastener is not strained. However, the distance "b" is preferably larger than "a" by a predetermined amount so that the flexible fastener 38 is strained such that the fastener 38 biases the post 20 toward the base 80 of the channel 24. The difference in these distances "a" and "b" provide the ability to control the amount of strain experienced by the flexible fastener in the various positions and enables the amount of bias and resistance to rotation of the post 20 to be controlled. Other examples of satisfactory hole shapes include round, diamond, square, etc. It is to be understood that the hole 36 in the post 20 may be of any shape. Preferably, the hole shape does not pre-stress or mark the fastener.

Figure 13:
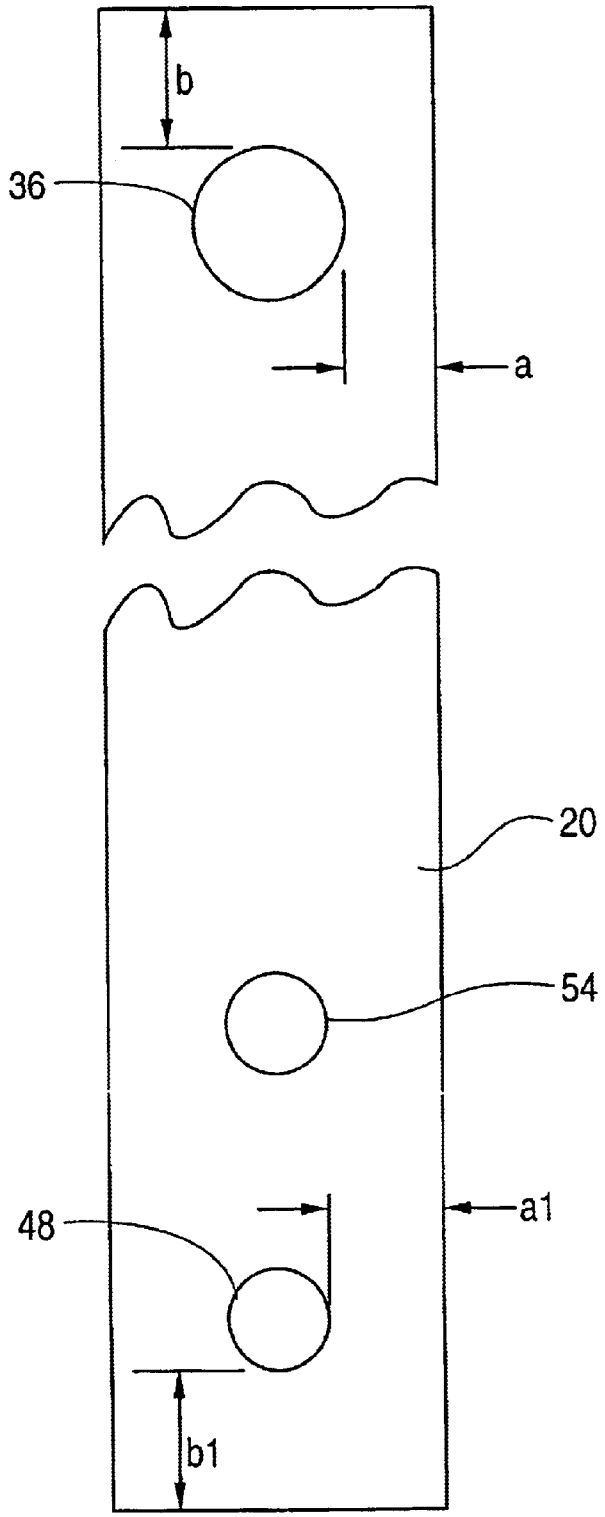
FIG. 13 is an elevation view of yet another exemplary embodiment of a post with a circular hole.

FIG. 13 shows a side view of another exemplary embodiment of a support post 20 in accordance with the invention. The support post 20 of FIG. 13 has a round hole 36 positioned toward the top end of the post 20. The hole 36 may be sized and positioned such that the distances a and b provide only a minimal amount of tension when the post is in the stored position and the deployed position, yet the transition from the stored position to the deployed position cams the flexible fastener 38 along the circular inner surface of the hole 36 while the fastener is tensioned during the transition. Similarly, the hole 48 toward the bottom of the post 20 may be similarly sized and positioned to provide a tensioned camming action during the deployment of a shoe 40. In a preferred embodiment, the hole 36 is slightly larger than the hole 48 such that b is greater than a by about 1/16" so that there will be no stress placed on the flexible fastener while the post is in the stored position. The b1 dimension is smaller than b to allow the shoe to articulate and float. This design allows the shoe to float either in contact with the end of the post or have a gap without any pressure being exerted by the flexible fastener when the shoe is rotated into the deployed position. Once deployed, the shoe may be in contact with one side wall of the post end and have a small gap on the opposite side wall without putting pressure on the flexible fastener.

Figure 14:
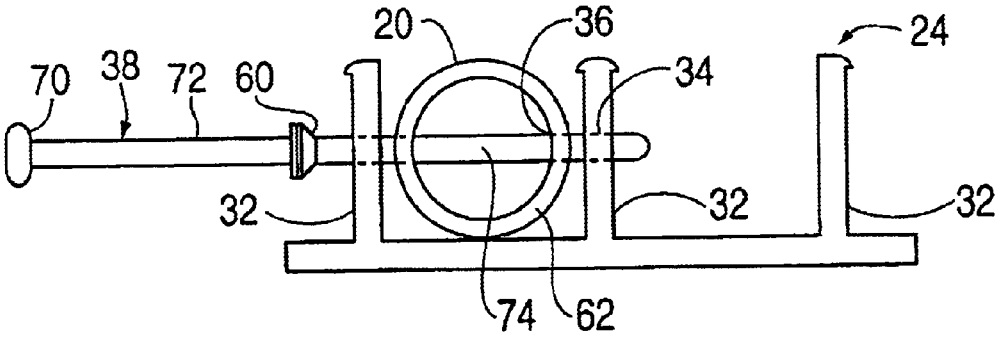
FIG. 14 is an end view showing a step in the installation of a flexible fastener through a post and channel in accordance with an exemplary embodiment of the invention.
Figure 15:
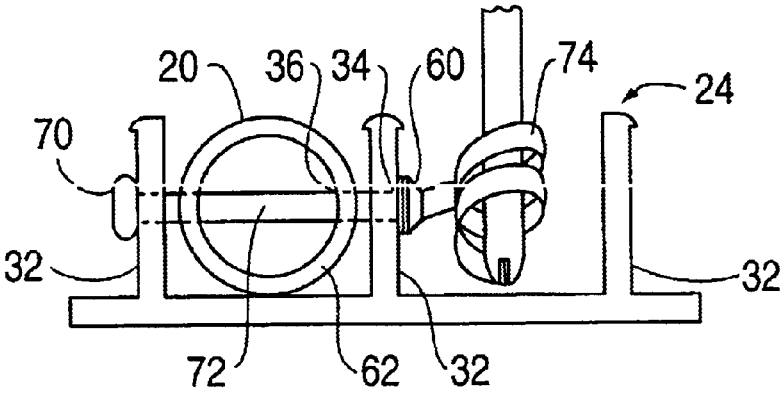
FIG. 15 is an end view showing a second step in the installation of a flexible fastener through a post and channel in accordance with an exemplary embodiment of the invention.

FIG. 14 shows an end view of a step in the process of the installation of the flexible fastener 38 through the walls 32 of the channel 24 and the post 20. The installation tail 74 (FIG. 17) is inserted through the walls 32 of the channel 24 and the post 20. Then, as shown in FIG. 15, a slot 82 (FIG. 16) in an installation tool 76 is slipped over then installation tail 74. The rotary drill 78 is then activated to rotate the installation tool 76. The installation tool 76 grabs the installation tail 74 and pulls the tail 74 while the tail 74 wraps around the tool 76. Thereby, pulling the barrel catch 60 through the walls 32 of the channel 24 and the post 20. Subsequently, the tool 76 is removed and the installation tail 74 is trimmed off of the barrel catch 60.

Figure 16:
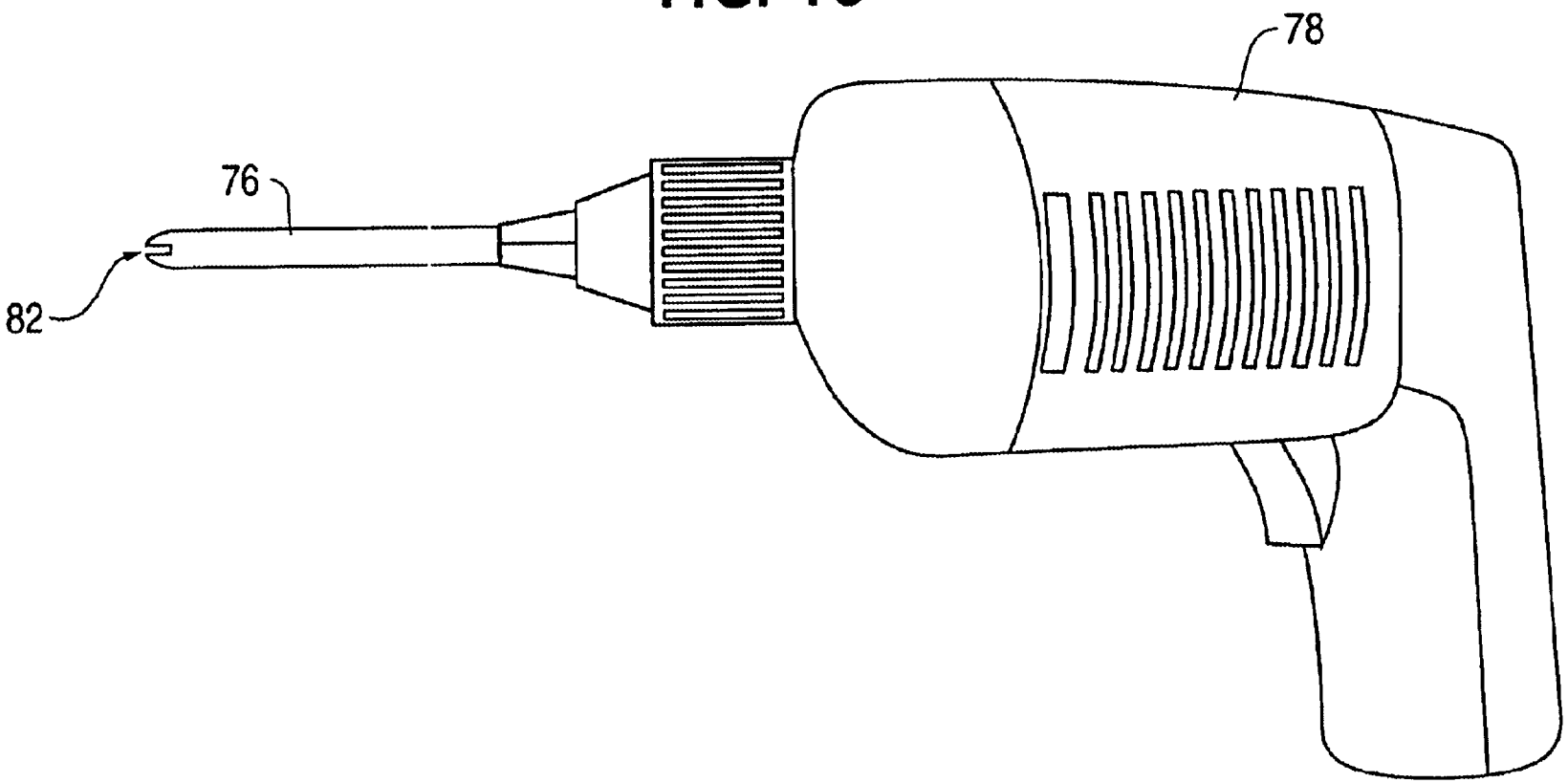
FIG. 16 is a side view of a flexible fastener installation tool in accordance with one exemplary embodiment of the invention.
Figure 17:
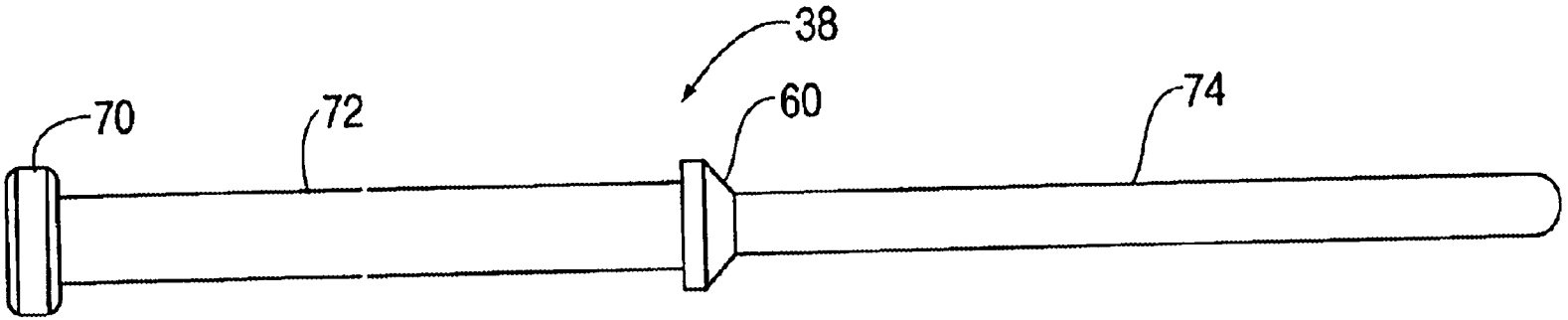
FIG. 17 is a side view of a flexible fastener in accordance with one exemplary embodiment of the invention.

FIG. 17 shows the flexible fastener 38 of the first exemplary embodiment of the invention. The flexible fastener 38 includes a head 70, a barrel 72, a barrel catch 60 and an installation tail 74. FIG. 16 shows the installation tool 76 attached to a rotary drill 78.

The flexible fastener of the first exemplary embodiment of the invention may be made with any elastic material that allows the fastener to stretch to allow the post to rotate and which, preferably, does not lose the ability to bias the post toward the channel once in the deployed position. The fastener should also remain in its elastic range during rotation of the post to prevent permanent deformation of the fastener. Additionally, the preferred fastener should be made of a material that will resist cuts, and wear and have a durometer range of 90 Shore A and 96 shore A. If the material is too rigid, the end of the post may be crushed, distorted and/or permanently altered which may reduce the ability of the post to maintain its deployed position due to a reduction in contact surface with the channel. Materials for a flexible fastener which may meet these conditions include thermoplastic urethanes, neoprenes, flex vinyls, thermoplastic olefins, thermo plastic elastomerics and the like. The material for the flexible fastener should also preferably be capable of withstanding a pull out and/or shear load. The material of the fastener may also exhibit a memory for the original straight configuration. Similarly, the shoe, the channel and the post should be made of materials that interact with the flexible fastener as described above. The components of the described system may be manufactured by any of the following methods without limitation: injection molding, extrusion, pulltrusion, bending, thermo-forming, vacuum-forming, structural foam, masonry processes, metal forming, wood forming, etc.

Figures 18A, 18B, 18C:
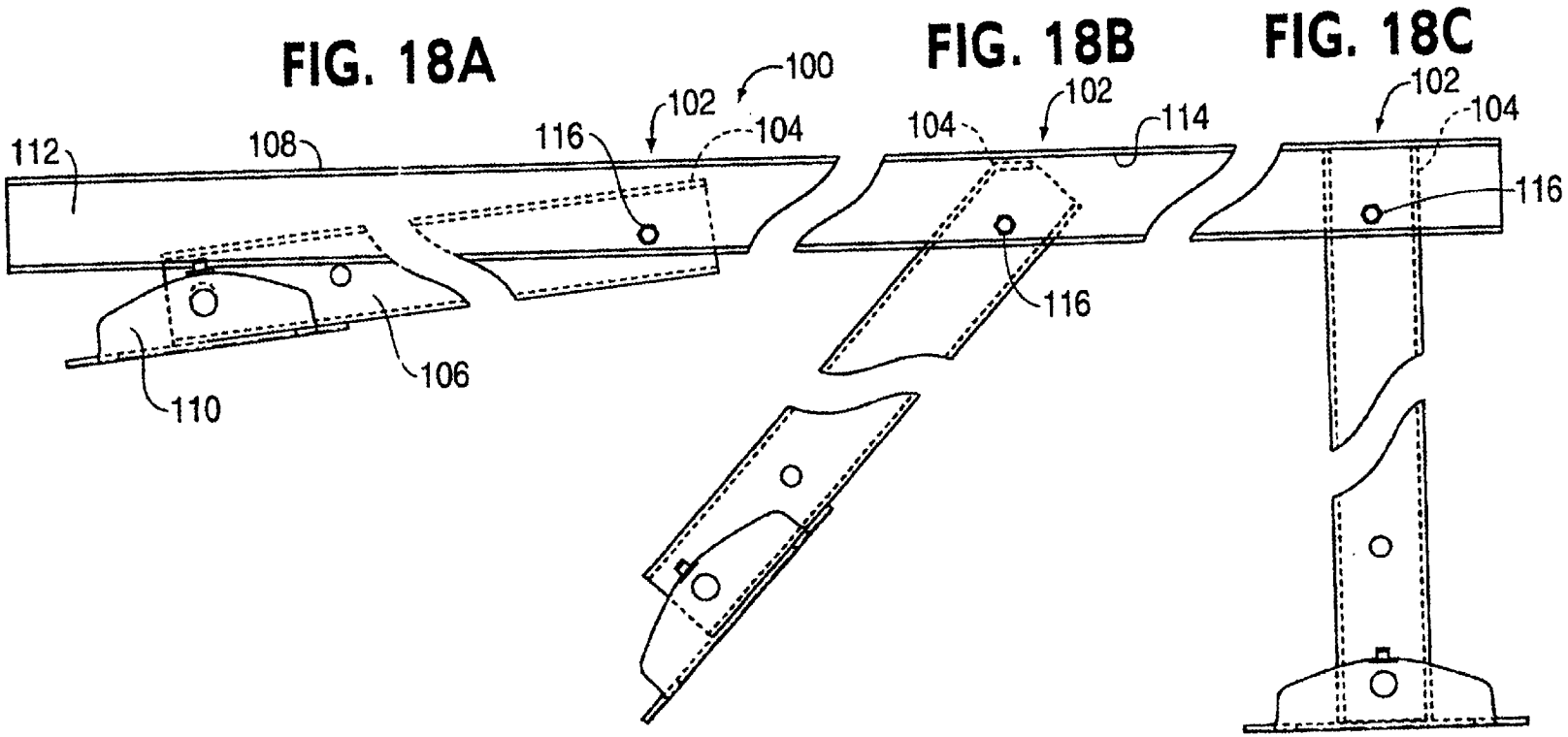
FIGS. 18A–18C show a side view of a second exemplary embodiment of the flexible engagement in accordance with the invention.

FIGS. 18A–18C show side views of a second exemplary embodiment 100 of the invention. The second exemplary embodiment includes a flexible engagement 102 that includes a rigid fastener 116 and which relies upon the flexibility of the top 104 of the post 106. The rigid fastener 116 may be a threaded bolt extending through the channel 108 and the post 106 and having a threaded nut securing the rigid fastener 116. FIG. 18A shows the post 106 in the stored configuration within the channel 108. The shoe 110 on the post 106 is latched onto the walls 112 of the channel 108 in FIG. 18A. The shoe 110 is unlatched from the walls 112 of the channel 108 and the post 106 is rotated downward to the intermediate position shown in FIG. 18B. As the post 106 is rotated, the top 104 of the post 106 comes into contact with the base 114 of the channel 108. As shown in FIG. 18B the top 104 is flexible and deforms as the top 104 comes into contact with the base 114 and the post 106 is rotated. The deformation of the top 104 enables the post 106 to be rotated into the deployed position shown in FIG. 18C.

Figures 19A, 19B, 19C:
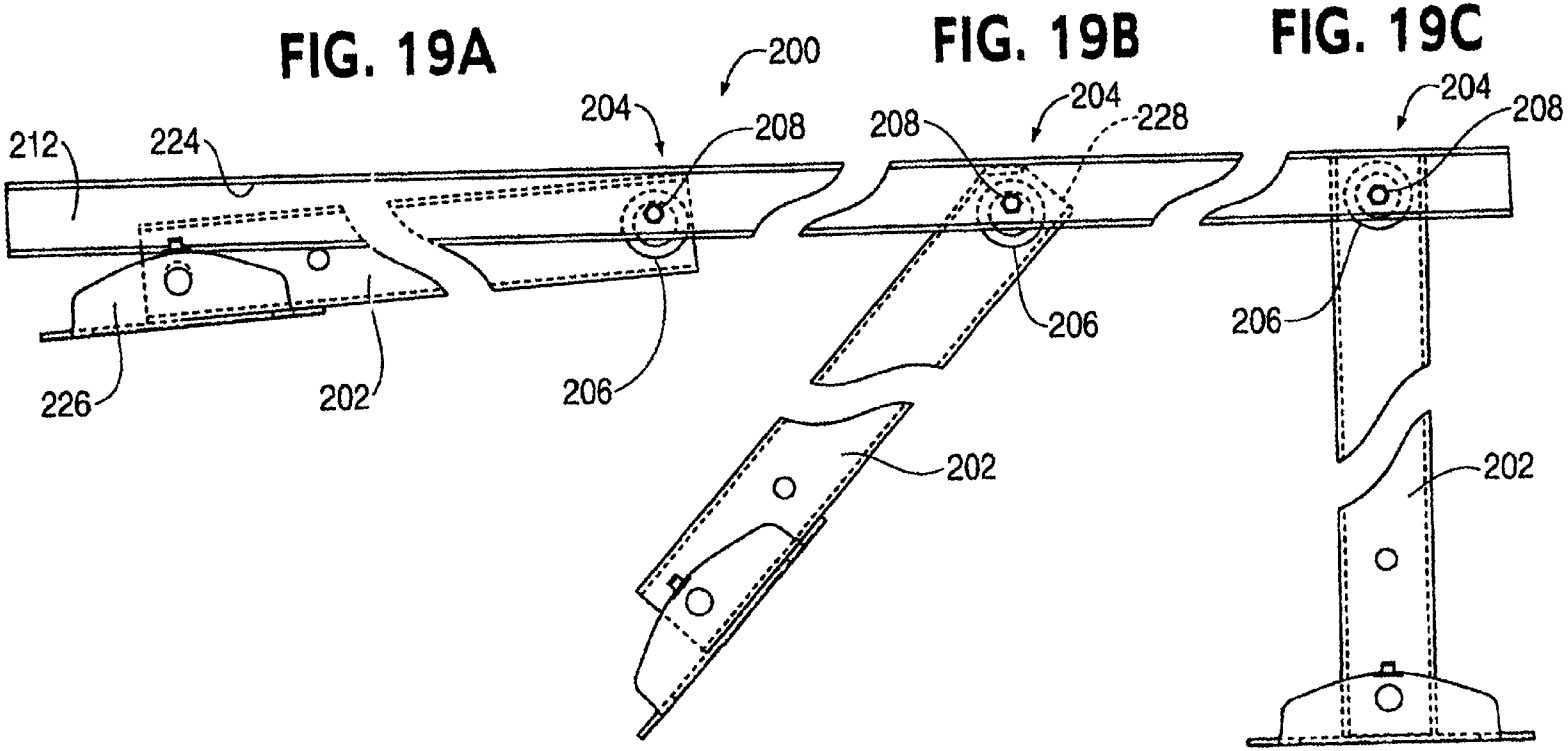
FIGS. 19A–19C show a side view of a third exemplary embodiment of the flexible engagement in accordance with the invention.
Figure 20:
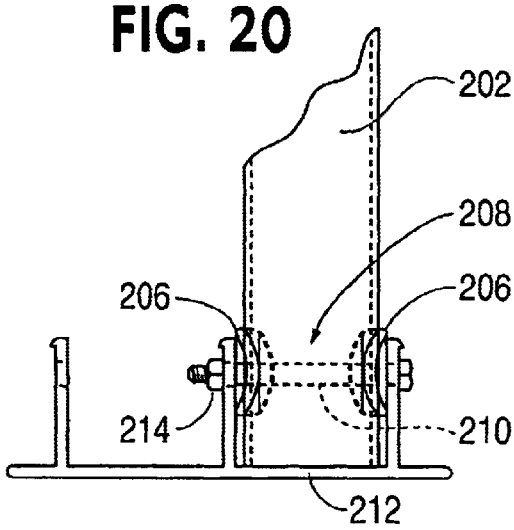
FIG. 20 shows an end view of the flexible engagement of the third exemplary embodiment of FIGS. 19A–19C.
Figure 21:
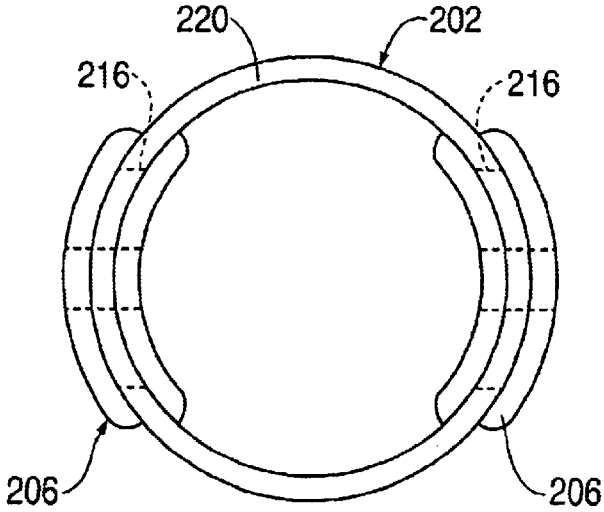
FIG. 21 shows a cross-section of the support post and flexible bushings of the flexible engagement of the third exemplary embodiment of FIGS. 19A–19C.
Figure 22:
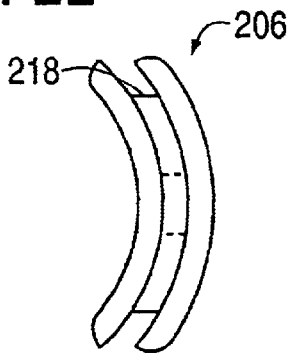
FIG. 22 shows an end view of the flexible bushing of the flexible engagement of the third exemplary embodiment of FIGS. 19A–19C.
Figure 23:
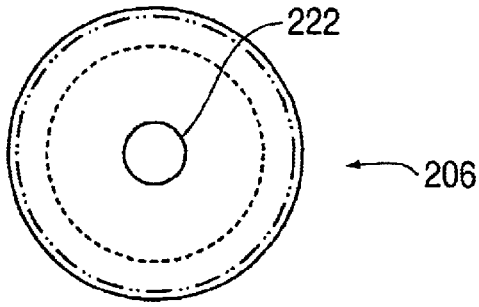
FIG. 23 shows a side view of the flexible bushing of FIG. 22.

FIGS. 19A–19C show a side view of a third exemplary embodiment 200 of the invention with its post 202 in its stored, intermediate and deployed positions, respectively. The third exemplary embodiment 200 has a flexible engagement 204 that includes a flexible bushing 206 and a rigid fastener 208. As shown in FIG. 20, the rigid fastener 208 includes a threaded bolt 210 which passes through flexible bushings 206, the post 202 and the channel 212 and which threadably receives a threaded nut 214. As shown in FIG. 21, the post 202 includes holes 216 which receive the flexible bushings 206. The flexible bushing 206 includes grooves 218 (FIG. 22) which receive the wall 220 of the post 202. Each flexible bushing 206 also includes a centrally positioned hole 222 through which the threaded fastener 208 passes.

Referring back now to FIGS. 19A–19C, it becomes clear how the operation of the flexible bushing 206 operates to provide a flexible engagement 204 between the post 202 and the channel 212. In the stored configuration, the post 202 contacts the base 224 of the channel and causes the hole 222 in the flexible bushing 206 to be offset slightly. The flexible bushing 206 may bias the post 202 toward the base 224 of the channel in the stored configuration. As described above with respect to FIGS. 18A–18C, the shoe 226 is unlatched from the channel 212 and the post 202 is rotated to the intermediate position shown in FIG. 19B. As is shown in FIG. 19B, the top portion of the post 202 in contact with the base 224 of the channel may slightly deform and the flexible bushing 206 also may deform. As the post 202 is further rotated to the deployed position shown in FIG. 19C, the top end 228 of the post 202 will come into contact with the base 224 of the channel 212 and the hole 222 in the flexible bushing 206 may become centrally located within the bushing 206.

Figures 24A, 24B, 24C:
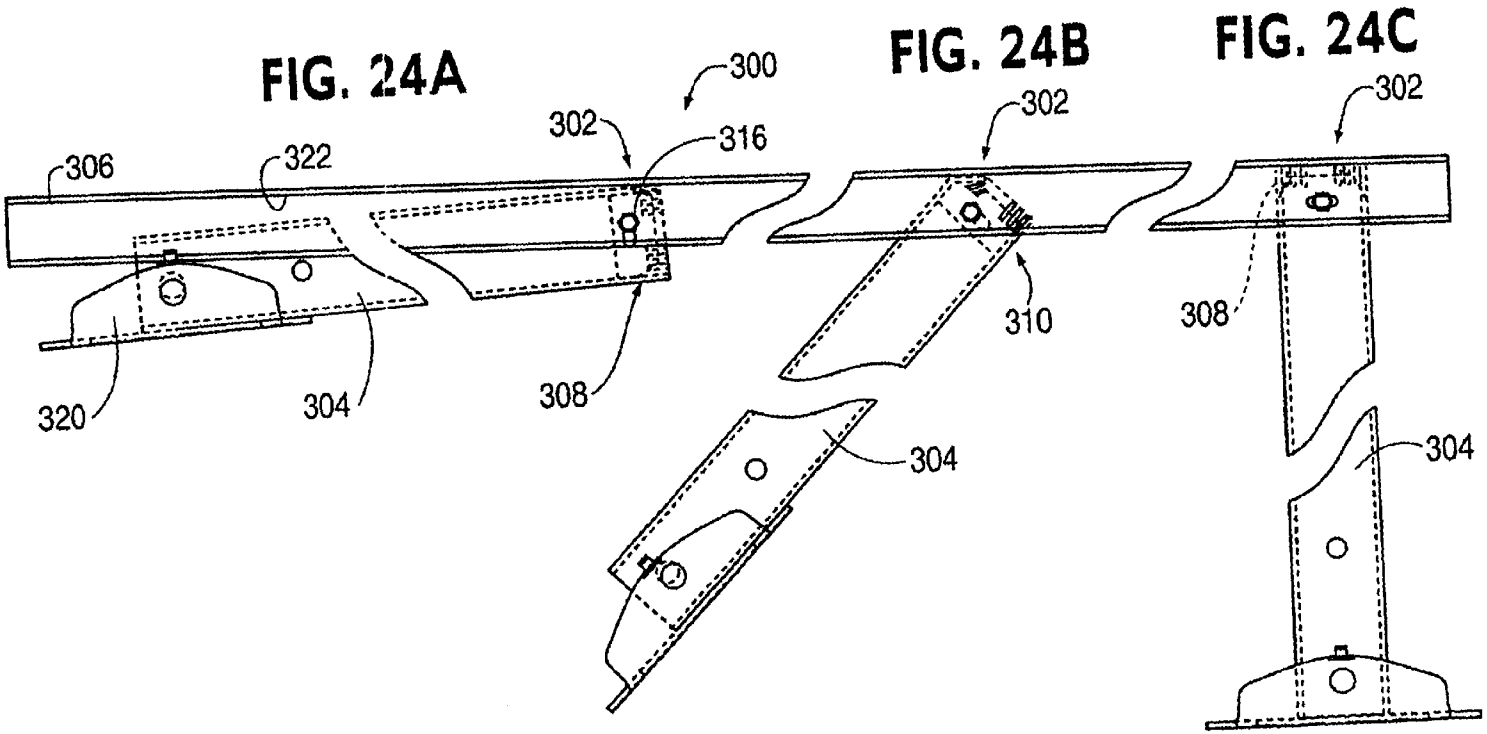
FIGS. 24A–24C shows a side view of a fourth exemplary embodiment of the flexible engagement in accordance with the invention.

FIGS. 24A–24C show a side view of a fourth exemplary embodiment 300 of the invention with the post 304 in its stored, intermediate and deployed positions, respectively. The fourth exemplary embodiment 300 includes a flexible engagement 302 between the post 304 and the channel 306 with a flexible insert 308. The post 304 is tubular and receives the flexible insert 308 in a top end 310 of the post 304.

Figure 26:
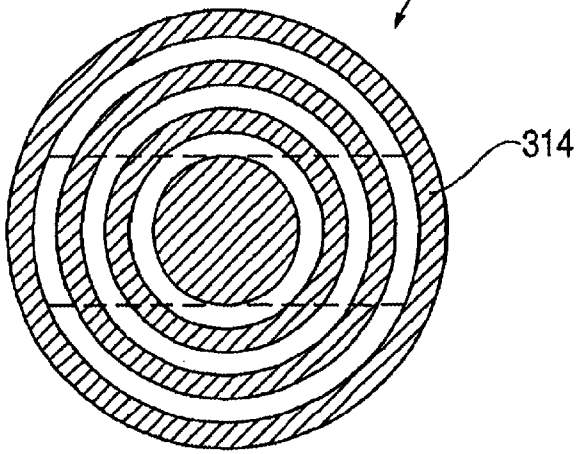
FIG. 26 shows a bottom view of the flexible insert of the flexible engagement of the fourth exemplary embodiment of FIGS. 24A–24C.
Figure 28:
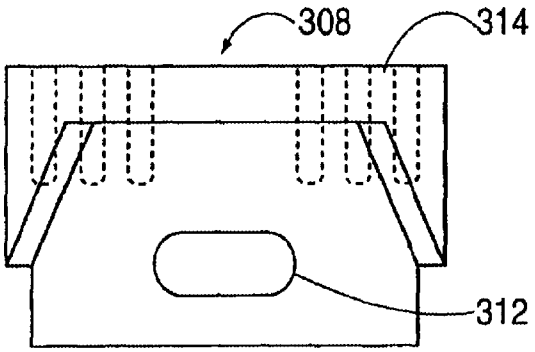
FIG. 28 shows a second side view of the flexible insert of FIG. 26.
Figure 25:
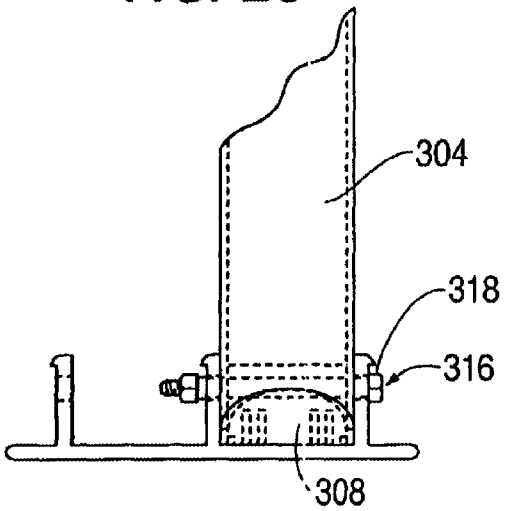
FIG. 25 shows an end view of the deployed fourth exemplary embodiment of FIG. 24C.
Figure 27:
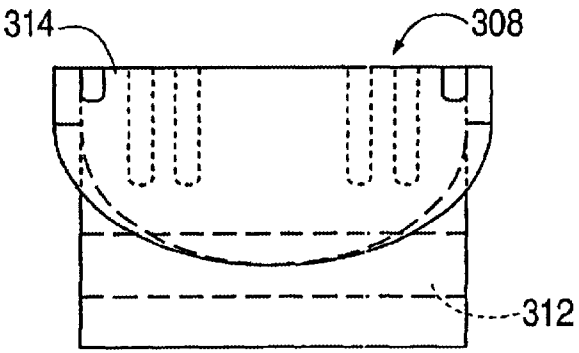
FIG. 27 shows a first side view of the flexible insert of FIG. 26.

FIGS. 26–28 show the flexible insert 308 of the fourth exemplary embodiment 300. The flexible insert 308 includes a slotted hole 312 and a series of concentric rings 314. The concentric rings 314 are not required, but enable the insert 308 to be made from a harder or higher durometer material than otherwise useable with a solid insert (not shown). The insert 308 may be made of substantially any material as long as the insert 308 is flexible enough to deform enough to allow the post 304 to rotate from the stored position (shown in FIG. 24A) to the deployed position (shown in FIG. 24C). As shown in FIG. 25, the flexible insert 308 is connected to the post 304 using a rigid fastener 316 such as a threaded bolt that passes through the post 304 and the slotted hole 312 of the insert 308.

As shown in FIGS. 24A–24C, the post 304 is deployed by unlatching the shoe 320 from the channel 306 and rotating the post 304 through an intermediate position (FIG. 24B) to the deployed position (FIG. 24C). As the post 304 rotates, the insert 308 comes into contact with the base 322 of the channel 306 and deforms to allow the post 304 to continue to rotate into the deployed position.

In yet another embodiment (not shown), the slotted hole in the flexible insert may be smaller than the slotted hole in the wall of the support post such that the flexible insert extends out through the slotted hole in the wall of the support post. In this manner, the portion of the flexible insert between the rigid fastener and the wall of the support post may also deform in a manner similar to the flexible bushing of the third exemplary embodiment. Thus, the flexible engagement may be provided both through deformation of the top surface of the flexible insert and the portion of the insert between the rigid fastener and the walls of the support post.

The stair shell of module contemplated for use with the invention includes stairs prefabricated and carried to a construction site and made from any of a wide variety of materials such as metal, wood or plastic and preferably of a high strength plastic such as fiberglass, reinforced plastic or any suitable thermosetting high impact resin or thermoplastic such as polycarbonate, acrylonitrile-butadiene-styrene, available as a weatherable polymer, polyvinyl chloride, nylon and the like.

An inherent advantage of the support system of the invention resides in that it substantially facilitates the installation of the stair modules by allowing the support method to progress from the top down. In other words, in the support system of the invention, the construction includes rotating each of the support posts from the stored position in the channels to the deployed position substantially perpendicular from the channel and rotating the shoes into a position substantially perpendicular from the posts. It is not necessary to attach posts and shoes at the construction site, thereby significantly improving the installation process. Although, extra posts and shoes may be provided for infield installation.

The stair module support system of the invention has particular applicability to below-ground swimming pools. However, the system of the invention is also substantially advantageous when applied to stair modules for above-ground swimming pools leading from the elevated deck down to the bottom of the pool interior and/or from the deck down to the ground level of the pool interior and/or from the deck down to the ground level exterior to the pool.

In a typical installation of the support system of the invention, the modular stair unit is brought on site, the shoes of each post are unlatched from their channel and the posts are rotated from the stored position to the deployed position. The flexible engagement between the posts and their respective channels may serve to positively angularly position each post relative to its corresponding channel. Similarly, the shoes on the end of each post are rotated from the stored position to the deployed position. Optionally, rerod may be affixed to the lower end of each post. When the support system is to be installed in the ground, a suitable excavation is made in the ground to a suitable depth to accommodate the shoes and rerod. Preferably, the excavation is measured and dug to a level slightly less than the desired level. The stair module containing the deployed post supporting assembly is then placed into position and the ground scraped as necessary to bring the stair module to a level condition. When installed contiguous to an opening formed in a pool wall, the stair module is aligned with the opening and the ground beneath the posts is removed until the desired alignment of the sides of the stair module with the pool wall is achieved. The shoes are then staked to hold the module and support systems in place and a concrete footing is poured around the base of the vertical support posts and over the staked shoes and reinforcing rods.

While the exemplary embodiments have been described as having posts extending from the stair module, it is understood by those of ordinary skill in the art that the meaning of the term post is intended to include a column, vertical channel, vertical member or other support.

Additionally, while the exemplary embodiments above have been described as having a rigidizing channel on the stair module which flexibly engages the post, it is to be understood that other means of flexibly engaging the post to the stair module may be used and still practice the invention. For example, the posts may flexibly engage support plates and/or pads or may directly flexibly engage the stair module. Also, while the exemplary embodiments have generally shown that the rigidizing channels are bonded, mechanically fastened or otherwise connected to the stair module, it is to be understood that the channels may be connected in any manner and still form a part of the invention. For example, the channels may be mechanically fastened or otherwise connected to the stair module.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of the invention.

What is claimed is:

1. A support for securing a stair module on a substrate comprising a flexible engagement between a support post and the underside of the stair module, wherein the support post is rotatable between a stored position and a deployed position, the flexible engagement at least partially deflecting as the support post is rotated between the stored position and the deployed position, and biasing the support post against the stair module in the deployed position.

2. The support of claim 1, wherein the flexible engagement comprises a rigidizing channel connected to the stair module.

3. The support of claim 1, wherein the flexible engagement comprises a flexible fastener extending through a rigidizing channel and the support post.

4. The support of claim 1, further comprising a shoe connected to said support post.

5. The support of claim 4, wherein the shoe flexibly engages said support post.

6. The support of claim 5, wherein the flexible engagement comprises a flexible fastener.

7. The support of claim 4, further comprising a rigidizing channel connected to the stair module and including flanges on side walls of the channel, wherein the shoe includes hooks adapted to engage the flanges to latch the support post into a stored position in the rigidizing channel.

8. The support of claim 1, wherein the flexible engagement comprises a circular hole passing through the post.

9. The support of claim 1, wherein the flexible engagement comprises a non-circular hole passing through the post.

10. The support of claim 9, wherein the non-circular hole is a triangular hole.

11. The support of claim 1, wherein the flexible engagement comprises:

a flexible bushing positioned in a hole passing through the support post; and a rigid fastener passing through a hole in the flexible bushing and through walls of a rigidizing channel connected to the stair module.

12. A support for securing a stair module on a substrate comprising a flexible engagement between a support post and the underside of the stair module, wherein the support post is rotatable between a stored position and a deployed position, wherein the flexible engagement comprises a flexible fastener extending through a rigidizing channel and the support post, wherein the flexible fastener comprises a head on the outside of a first wall of the rigidizing channel, a flexible shaft extending from the head and a barrel catch at an opposing end of the flexible shaft and outside a second wall of the rigidizing channel.

13. A support for securing a stair module on a substrate comprising a flexible engagement between a support post and the underside of the stair module, wherein the support post is rotatable between a stored position and a deployed position, wherein the flexible engagement comprises a rigid fastener passing through the support post and a rigidizing channel, and wherein the top of the support post is adapted to deform to allow the support post to rotate about the rigid fastener from the stored position to the deployed position.

14. A support for securing a stair module on a substrate comprising a flexible engagement between a support post and the underside of the stair module, wherein the support post is rotatable between a stored position and a deployed position, wherein the flexible engagement comprises:

a flexible bushing positioned in a hole Passing through the support post; and a rigid fastener passing through a hole in the flexible bushing and through walls of a rigidizing channel connected to the stair module, wherein the flexible bushing biases the support post into the rigidizing channel in the stored position.

15. A support for securing a stair module on a substrate comprising a flexible engagement between a support post and the underside of the stair module, wherein the support post is rotatable between a stored position and a deployed position, wherein the flexible engagement comprises a flexible insert received in an end of the support post, wherein the flexible insert is adapted to deform to allow the support post to rotate from the stored position to the deployed position.

16. The support of claim 15, further comprising a rigid fastener passing through walls of a rigidizing channel connected to the stair module, through a hole in the support post and through a hole in the flexible insert.

17. The support of claim 16, wherein the hole in the flexible insert is a slotted hole.

18. The support of claim 16, wherein the hole in the flexible insert is a round hole.

19. The support of claim 15, wherein a top surface of the flexible insert comprises at least one circular groove.

20. The support of claim 15, wherein a top surface of the flexible insert is solid.

21. A support for securing a stair module on a substrate comprising a support post and means for enabling rotation of the support post between a stored position and a deployed position, the means including a flexible engagement that at least partially deflects as the support post is rotated between the stored position and the deployed position, and biases the support post against the stair module in the deployed position.

* * * * *